US005163681A

United States Patent [19]

Hodgetts

[11] Patent Number: 5,163,681

[45] Date of Patent: Nov. 17, 1992

[54] GOLF CLUB MATCHING

[76] Inventor: George Hodgetts, 971 Orange Ave., West Haven, Conn. 06516

[21] Appl. No.: 694,648

[22] Filed: May 2, 1991

[51] Int. Cl.[5] ..... A63B 53/00

[52] U.S. Cl. ..... 273/77 A

[58] Field of Search ..... 273/77 R, 77 A

[56] References Cited

U.S. PATENT DOCUMENTS 3,444,729 5/1969 Shobert ..... 273/77 R 5,040,279 8/1991 Braly ..... 273/77 A X 5,094,101 3/1992 Chastonay ..... 273/77 A X

*Primary Examiner*—William H. Grieb

*Attorney, Agent, or Firm*—Bruce F. Jacobs

[57] ABSTRACT

Golf clubs can be matched either to duplicate a favorite club or to produce a matched set of clubs by determining a spectral response curve of a club and then matching other clubs thereto at at least about its natural frequency.

18 Claims, 5 Drawing Sheets

GOLF CLUB MATCHING

BACKGROUND OF THE INVENTION

Many golfers have one or two favorite clubs, which they prefer over the rest of the clubs in their set. The favorite club(s) usually feels and performs better for the golfer. If the golfer could duplicate the performance of this favorite club and make each of the clubs in his set feel and perform like his favorite club, the golfer could improve his game.

That a golfer finds a difference in behavior of one club from another in a set is not surprising due predominantly to normal shaft manufacturing tolerances. Shafts made from the same die can vary substantially. For example, steel shafts of a leading manufacturer are permitted to vary by up to ±2.5% in stiffness and still be within tolerance. With the difference between "regular" and "stiff" shafts or "stiff" and "extra stiff" being only about 2.5%, a shaft within a set can vary all the way from "regular" to "extra stiff" even though all the shafts in the set were made from a "stiff" die.

Attempts at duplication of a golf club to copy a single golf club or to produce a matched set of clubs are well known in the art. A variety of different methods have been proposed to accomplish these difficult tasks. One of the most popular techniques involves the determination of and then matching the natural frequency of the clubs or, in some instances, the club shafts. U.S. Pat. Nos. 3,395,571; 4,070,022; 4,122,593; 4,555,112; and 4,736,093 and U.K. Application No. 2,223,951 each disclose methods of duplicating golf clubs and/or producing matched golf club sets by means of club or shaft natural frequency matching.

U.S. Pat. No. 3,698,239 discloses a method of producing a dynamically matched set of clubs by starting with a favorite club, determining its moment of inertia of mass for a selected swinging axis by calculation from its length and weight, and producing the remaining set to have the same moment of inertia, by calculation. The use of the moment of inertia in the duplication of golf clubs is also disclosed in U.S. Pat. No. 4,128,242.

U.S. Pat. No. 4,175,440 discloses dynamic testing and matching of clubs by measuring the angular velocity and centrifugal force along the axis of the club shaft as the club is swung on an arcuate path using an adjustable power rotational drive means.

Overall mass matching is used in U.S. Pat. No. 4,415,156 to produce a matched set of clubs.

In U.S. Pat. No. 4,900,025 a correlated set of clubs is made by matching the shaft flexure characteristics such that the deflection of a reference point is substantially uniform when a given torque is applied at the point.

None of these techniques, however, have developed enough or in some cases the right information about a particular club to enable one to accurately and completely duplicate the club so that the duplicate club performs and feels like the club being duplicated.

Also, none of these techniques have developed enough or in some cases the right information about a particular club to enable one to accurately and completely match other clubs in a set so that the matched club(s) perform and feel like the first club.

Accordingly, it is an object of the present invention to develop a method and device to either duplicate a golf club or to produce a matched set of clubs so that the golfer using the produced clubs can not tell the difference between the clubs.

SUMMARY OF THE INVENTION

The present invention is directed to a method of duplicating a single golf club, a method of producing a matched set of golf clubs, and a device for carrying out the duplication or matching process. As used herein, the term "duplicating" means producing a golf club which feels and performs substantially the same as the golf club being duplicated when used in the same manner.

The duplicating or matching process generally comprises attaching a golf club to be duplicated or matched to an oscillating means at the club's grip end, oscillating the golf club over a range of frequencies, measuring at each frequency the excursion of the golf club head from a stationary position, and thereafter plotting the excursion versus the frequency of the club head to form a curve which is defined herein as a "spectral response curve." The curve formed by such plotting normally has a distinctive peak that appears at about the natural frequency of the golf club. The natural frequency is the frequency at which the maximum excursion occurs. Once a spectral response curve for the golf club to be duplicated or matched has been measured and plotted, a golf club shaft having substantially the same spectral response curve, at least at about the portions of the curve near the natural frequency of the club, is selected.

Preferably a multiplicity of golf club shafts are pretested to determine their spectral response curves by oscillating each shaft with dummy club heads attached thereto. Thus, when it is time to select an appropriate shaft, all that needs to be done is to select a shaft having a spectral response curve that is substantially the same as the spectral response curve of the club to be duplicated at least at about the portion of the curve corresponding to the natural frequency of the club. This comparison process may be carried out in any suitable manner including manually by using transparent overlays and electronically by using an appropriate computer program.

After an appropriate shaft of the same length is located, a club head of the same weight, size, loft, and lie as the head on the club being duplicated is attached to the new shaft.

Other properties and dimensions of the golf club which contribute to producing a duplicate of a golf club or a matched set of clubs include: the club swing weight and the overall weight of the club, the torque of the shaft, the flex point of the shaft, and the grip diameter of the grip end of the club. In duplicating a golf club or matching a set of golf clubs these properties and dimensions may also be duplicated or matched to produce the new club.

BRIEF DESCRIPTION OF THE DRAWINGS

FIG. 1(*b*) is a side view of the golf club of FIG. 1(*a*).

DETAILED DESCRIPTION OF THE INVENTION

Figure 1A:
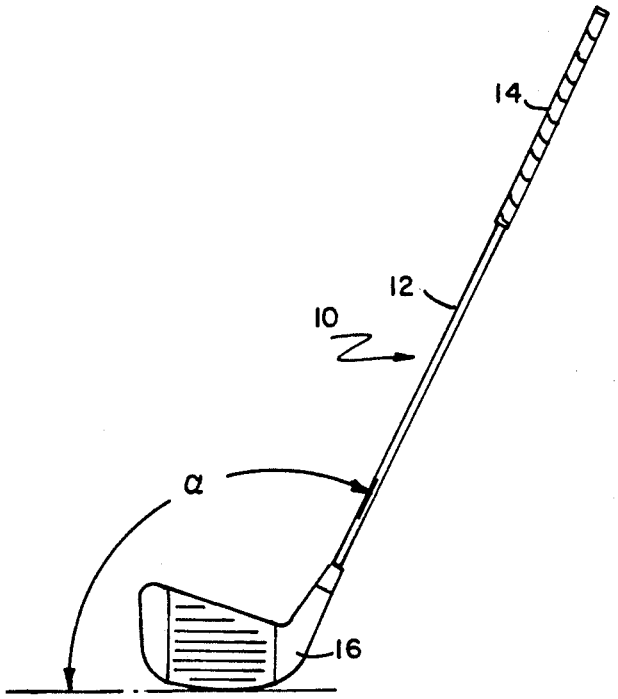
FIG. 1(*a*) is a plan view of a golf club.

As shown in the drawings, a golf club 10 comprises a shaft 12 having at one end a grip portion 14 and at the other end a club head 16. As is well known in the art, the club head may be either a "wood" head or an "iron" head. The term wood head refers to a particular type of club well known in the art used to drive golf balls longer distances than irons. It may be manufactured from a variety of conventional materials including metal, wood, graphite, and polycarbonate. Iron heads are generally made of materials such as cast or malleable iron or plastic composites and are generally used to drive golf balls shorter distances in comparison to the woods. The shaft may be made of any of a variety of conventional materials including steel, aluminum, graphite, or fiber-filled polycarbonate. A set of golf clubs generally comprises iron wedges such as the sand and pitching wedges, short irons (7-9 irons), long irons (2-6 irons), short woods (3-5 woods), and long woods (1-2 woods), though more or less clubs may be in an actual set.

According to the present invention, any golf club, whether it be a wood or an iron and notwithstanding the construction of the shaft or the materials used to form the shaft or head, may have its performance duplicated by the method herein.

Figure 2:
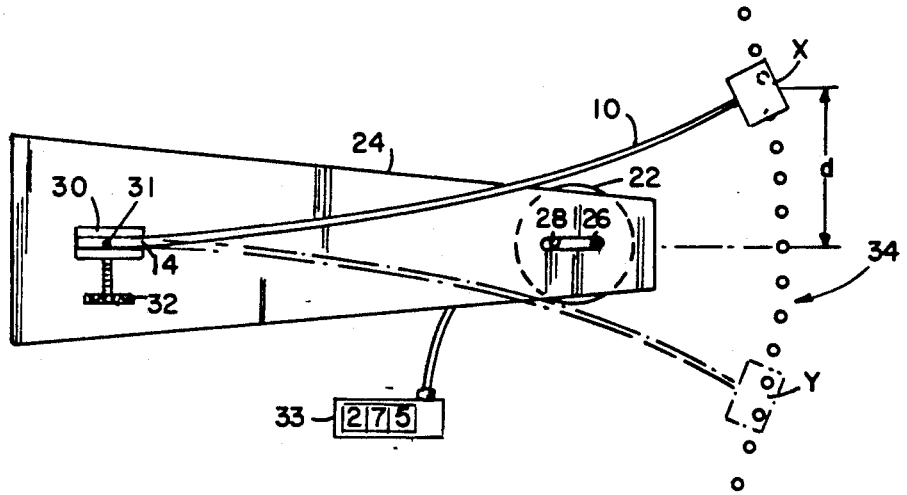
FIG. 2 is a top view showing the operation of an oscillating means according to the present invention.
Figure 3:
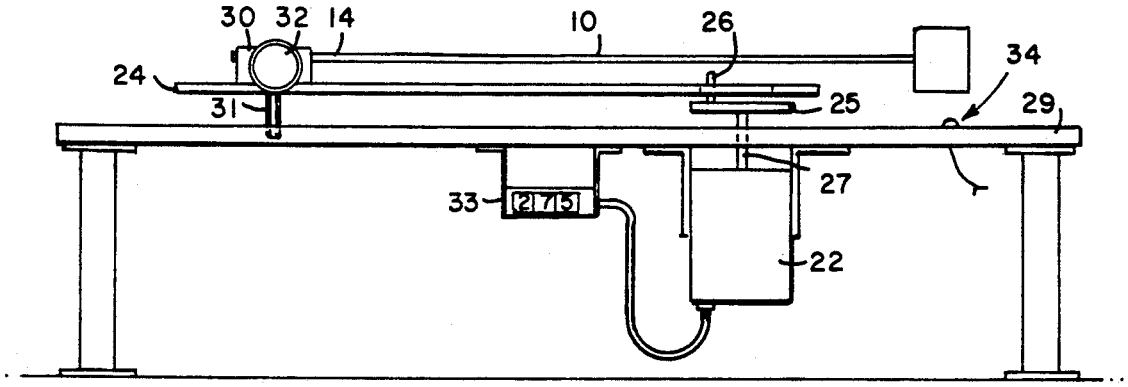
FIG. 3 is a side view of the oscillating means of FIG. 2.

The method according to the present invention comprises attaching the golf club to be duplicated or matched at its grip end to an oscillating means such as an oscillating motor and oscillating the club over a range of frequencies. Other oscillating means which may be employed include a linear motor attached to the grip end of the club, a servo motor programmed to oscillate back and forth, and a magnetically induced oscillating motor. While the specific frequency range used for the oscillations will depend upon the particular club and materials used to make the club, the range of frequencies used is generally from about 200 RPM to 800 RPM, preferably from about 225 RPM to 375 RPM. At each frequency, the excursion of the club head from its stationary position is measured. The excursion may be measured by any suitable means including a visual scale such as a ruler or the like or an optical sensor array. It is presently preferred to measure the excursion by a sensor array so that the phase angle, a parameter discussed hereinafter, may also be measured. If a visual scale such as a ruler is used, the phase angle measurement is not possible. According to an embodiment of the present invention and best shown in FIG. 2 to 3, a rotating motor 22 connected to an oscillating arm 24 by means of a pin 26 mounted on the outer edge of a disk 25 which is attached to the motor shaft 27. The pin 26 fits into a slot 28 in the oscillating arm 24. It is presently preferred to employ a rotating synchronous AC motor driven by a variable frequency controller which can hold a set point of speed at ±1 RPM. By this arrangement, the rotational movement of the motor is translated into oscillating movement in the oscillation arm 24, which is attached to surface 29 by means of a pin 31 so as to form a pivot at the grip end of the club. Attached to the oscillating arm 24 is a vise 30 used to hold the golf club 10 at its grip end 14. A screw 32 is used to tighten and loosen the vise. A tachometer 33 which is electrically connected to the motor is used to measure the speed of the motor. In this embodiment, an optical sensor array 34 arranged in a semi-circular path is used to measure the excursion of the club head. As shown, a set of light emitting diodes (LED's) are arranged in a semi-circle under the path that the clubhead subscribes with a sinusoidal generator (not shown) whose output magnitude is proportional to the highest order LED covered by the clubhead as it swings at each frequency. As an alternative to the optical sensor array, a strain gauge placed on the shaft of the club near the clubhead with an analog output could be employed. The analog output is a continuous voltage which is roughly proportional to the displacement of the clubhead. Still another measuring technique which could be employed is to use a strain gauge to measure the phase angle (hereinafter discussed) and an optical sensor with a short term memory to scan the LED's to sense the highest order LED intercepted by the clubhead. As shown, when the oscillating means is operating, the club head oscillates from one position shown at X to another position shown at Y. These X and Y points will change as the frequency of the motor is varied. The excursion of the club head is shown in FIG. 2 as the distance "d" which will also change as the frequency changes.

Figure 4:
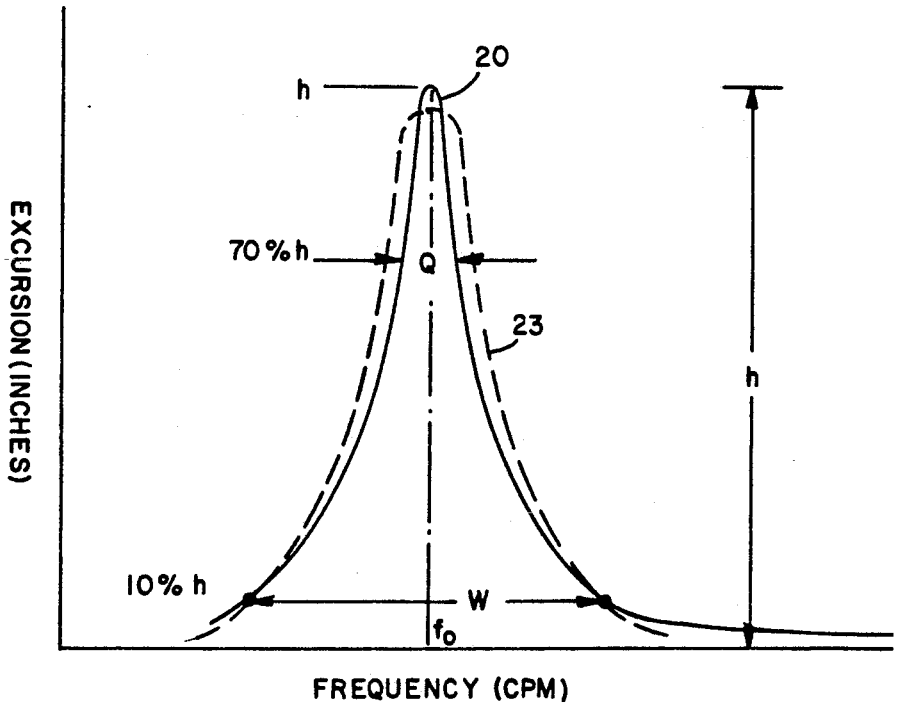
FIG. 4 is a graph showing matching spectral response curves according to the present invention.

The frequency and excursion measurements are then used to plot a curve, defined herein as a "spectral response curve." FIG. 4 shows such a curve 20 for a golf club. As shown, the spectral response curve has a distinctive peak. The peak is at the natural frequency ($f_o$) of the club. The shape of the curve at about the natural frequency of the club (the portion generally extending from the beginning of the upward slope and the ending of the downward slope shown as W in FIG. 4) provides important information about the performance of the club. Both the height of the peak at $f_o$ and the width of the peak at various percentages of the heights of the curve at $f_o$ are useful parameters in the process of duplicating or matching a golf club.

As shown in FIG. 4, the width of the spectral response measured at about 70% of the height "h" of the peak at $f_o$, shown as Q, represents the ability of the club to forgive off-speed swings. It also is a measure of mechanical gain which is in conflict with forgiveness; i.e. narrow peaked shafts result in high mechanical gain and non-forgiving clubs. Only players with very repetitive swings or those who hope to achieve distance at the expense of accuracy should play with narrow peaked shafts. When determining the characteristics of a club to produce a matched set of clubs therefrom, the width of the peak Q is important to consider. Width measurement of the curve at other points such as about 10% and 70% of the height of the peak at $f_o$ may also be used in matching the spectral response curve of the club to be duplicated or matched.

Once the spectral response curve for the golf club whose performance is to be duplicated is determined, the next step in the process is the selection of a club shaft which, when a club head substantially equal in weight to the club head being duplicated is attached thereto, has substantially the same spectral response curve as the golf club that is being duplicated or matched, at least at about the portions of the curve corresponding to the natural frequency of the golf club. As used herein, "substantially the same spectral response curve" means that the amplitudes of the two curves at the portions of the curves at about the $f_o$ peaks are within about ±10%, more preferably within about ±6%, and most preferably within about ±3%, and at other frequencies of the curves being matched within about ±15%, more preferably within about ±10% and most preferably within about ±7%. Preferably, the natural frequencies $f_o$, at which the peaks occur, are within ±1%, preferably ±0.5%, and most preferably ±0.1%. The spectral response curve for a suitable new club is shown, by means of example only, in FIG. 4 as a dotted line 23.

To obtain a more precise duplication, the spectral response curves of the club being duplicated can be matched with the new club over the same and entire frequency range measured.

Since the spectral response curves for various golf clubs may vary significantly from one golf club to another due to shaft design and shaft manufacturing tolerances, it is presently preferred to measure the spectral response curves for a large variety of shafts with various golf club heads or dummy heads simulating a golf club head attached thereto. Such spectral response curves can then be placed on file and matched to the spectral response curve of a golf shaft to be used to construct a golf club which a customer desires to duplicate or to which other clubs in a set are to be matched. The matching of the spectral response curves may be accomplished by any suitable means including using transparent overlays to match up the curves or using conventional electronic means such as a computer with appropriate programming to match the curves.

To make the duplication process more precise, two other parameters not directly associated with the spectral response curve may be measured and matched. Those two parameters are the flex point and the torque of the club shaft. The flex point is determined by oscillating the club as described above at a frequency of $2f_o$ and observing and identifying the point on the club shaft which is substantially stationary while the remainder of the club oscillates. This point is approximately two thirds of the distance from the grip end of the club to the club head. Two clubs having shafts of identical longitudinal stiffness but differing flex points may present a detectable "feel" variation to the golfer. Thus the flex points should be matched to more precisely duplicate the golf club. When the flex point of two clubs is being matched it should be at the same distance from the grip end of the club ± about 0.5 inches, more preferably ± about 0.25 inches, and most preferably ± about 0.1 inches.

Figure 5:
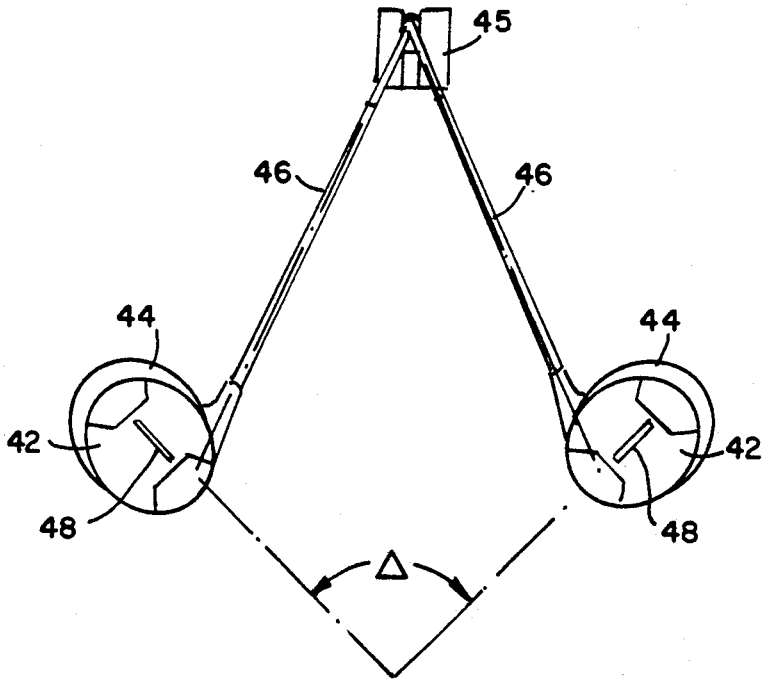
FIG. 5 is a front view of FIG. 2 showing the measurement of the torque.

The torque of the club is generally defined as the resistance to twisting of the club shaft. As shown in FIG. 5, it is measured by marking the sole plate 42 on club head 44 of the club 46 being duplicated with chalk or other suitable mark 48 and using a synchronized strobe light (not shown) to read the angle of deflection (Δ) when the club is oscillated at its natural frequency ($f_o$) using a suitable oscillating means 45 such as the device shown in FIG. 2. This deflection is caused by the center of gravity of the club head being located off the center of the shaft. The torque of the duplicate or matched club should generally be about equal to or stiffer than the club being duplicated, which translates into an angle Δ for the duplicate club of about equal to or less than the angle Δ possessed by the club being duplicated.

One method according to the present invention of obtaining a fairly precise duplication is to match each of the following parameters: (1) the natural frequency $f_o$ (± about 0.1%); (2) the height of the peak at the natural frequency $f_o$ (± about 1.0 inch); (3) the width of the peak Q at 70% of the height of the peak measured from the bottom of the curve at the natural frequency (± about 2.0 CPM); (4) the width of the peak at 10% of the height of the peak measured from the bottom of the curve at the natural frequency (±4.0 about CPM); (5) the flex point (± about 0.5 inch); and (6) the torque (an angle about equal to or less than of the club to be duplicated.) This method will result in matching the curves at about the natural frequency of the two clubs within the tolerances recited hereinabove.

Figure 1B:
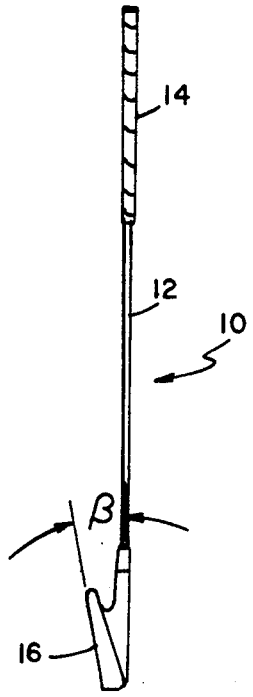

Once the curves and any other desired parameters are matched and the appropriate new shafts thereby determined, the shaft is cut to an appropriate length. The length for the duplication of a golf club is substantially the same as the length of the initial golf club. A club head substantially the same as the club head of the golf club being duplicated is then attached thereto. A club head which is substantially the same should be of the same weight ± about 2.0 grams, more preferably ± about 1.0 grams, and also have the same lie ± about 0.5°, more preferably ± about 0.2°. It is not necessary, however, that the club head be made of the same materials as the head of the club being duplicated. The lie of the club head is the angle α shown in FIG. 1(*a*). The loft is the angle β shown in FIG. 1(*b*). The loft is more conventionally represented by the club number, e.g. 5 iron, 3 wood. Thus, two 7 irons will generally have substantially the same loft. The variations of loft and lie angles between successive clubs in a set are well known.

To complete the duplication of the club, the new club shaft should preferably have substantially the same grip diameter as the club being duplicated. The grip diameter should generally not vary from the original by more than about ±1/32 inch, more preferably by not more than about 1/64 inch. In addition, the new club should have a swing weight (described below) within about ±1, more preferable about ±½, swing weights of the club being duplicated. The overall weight of the two clubs should be within about ±9 grams, more preferably ± about 4 grams, most preferably ± about 2 grams.

Figure 6:
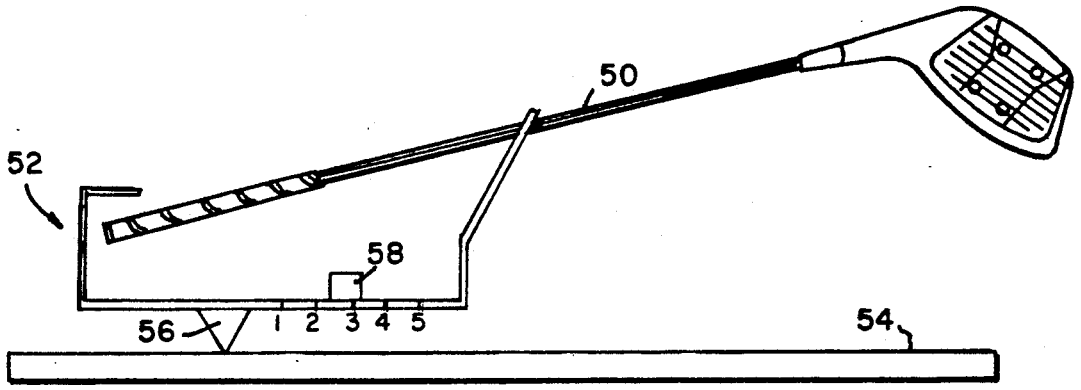
FIG. 6 is a plan view showing a counterbalance used to measure the swing weight of the golf club.

FIG. 6 shows one method for the measurement of the swing weight of a club. A club 50 is placed on a counterbalanced scale 52 on a flat surface 54 and is balanced on the fulcrum 56 using a sliding counterweight 58. A swing weight is a scale factor defined when an increment of weight is added to the club head such that the counterbalance is moved one scale increment. The scale that is used is arbitrary. It is important, however, that the same scale be used in measuring the swing weight for the club being duplicated and the new matching club.

Figure 7:
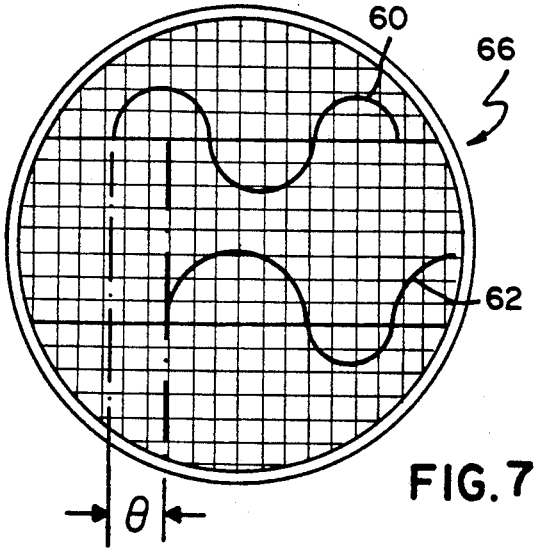
FIG. 7 is a plan view of an oscilloscope showing the measurement of the phase angle.

While not necessary to duplicate a club, a parameter defined herein as the "phase angle" may be duplicated to obtain very precise duplication. As described previously, the motor used to oscillate the club during the duplication process is an AC driven motor. An AC voltage used to drive the motor produces a sine wave when displayed on an oscilloscope. Such a sine wave has a magnitude and a phase angle. The optical sensor array, which may be used to measure the club head excursion, produces a voltage which exhibits a sine wave. As shown in FIG. 7, the sine wave 60 of the motor and the sine wave 62 of the optical sensor may be displayed on a dual trace oscilloscope 66. The phase angle $\theta$ of the golf club is measured as shown. In order to match phase angles of two different shafts for the purposes of duplicating a club, the phase angles of the two clubs should be within the range of about ±5 degrees, more preferably within about ±2 degrees, of each other.

Once the spectral response curve of a particular club has been determined or a particular club has been duplicated, an entire set of clubs or any subset thereof may be made having analogous characteristics to the particular club. Generally, each number club differs from the next numbered club by about ½ inch in shaft length. For example, a 5 iron is normally about ½ inch shorter than a 4 iron which is normally about ½ inch shorter than a 3 iron, etc. In order to manufacture a set or subset of golf clubs having the same performance characteristics, the spectral response curve for a single club is determined in the manner described above. While the single club (or clubs) to which other clubs in a set is to be matched will preferably be the user's favorite club, other techniques for identifying the appropriate starting club may be utilized. For instance, a player can evaluate on a practice tee a calibrated selection of test clubs to identify the club which he prefers. Or a player's swing can be videotaped and superimposed upon images of other player's swings (for which a preferred club is known) until a match is found and then producing clubs of the same spectral response curve as those of the known player.

Figure 8:
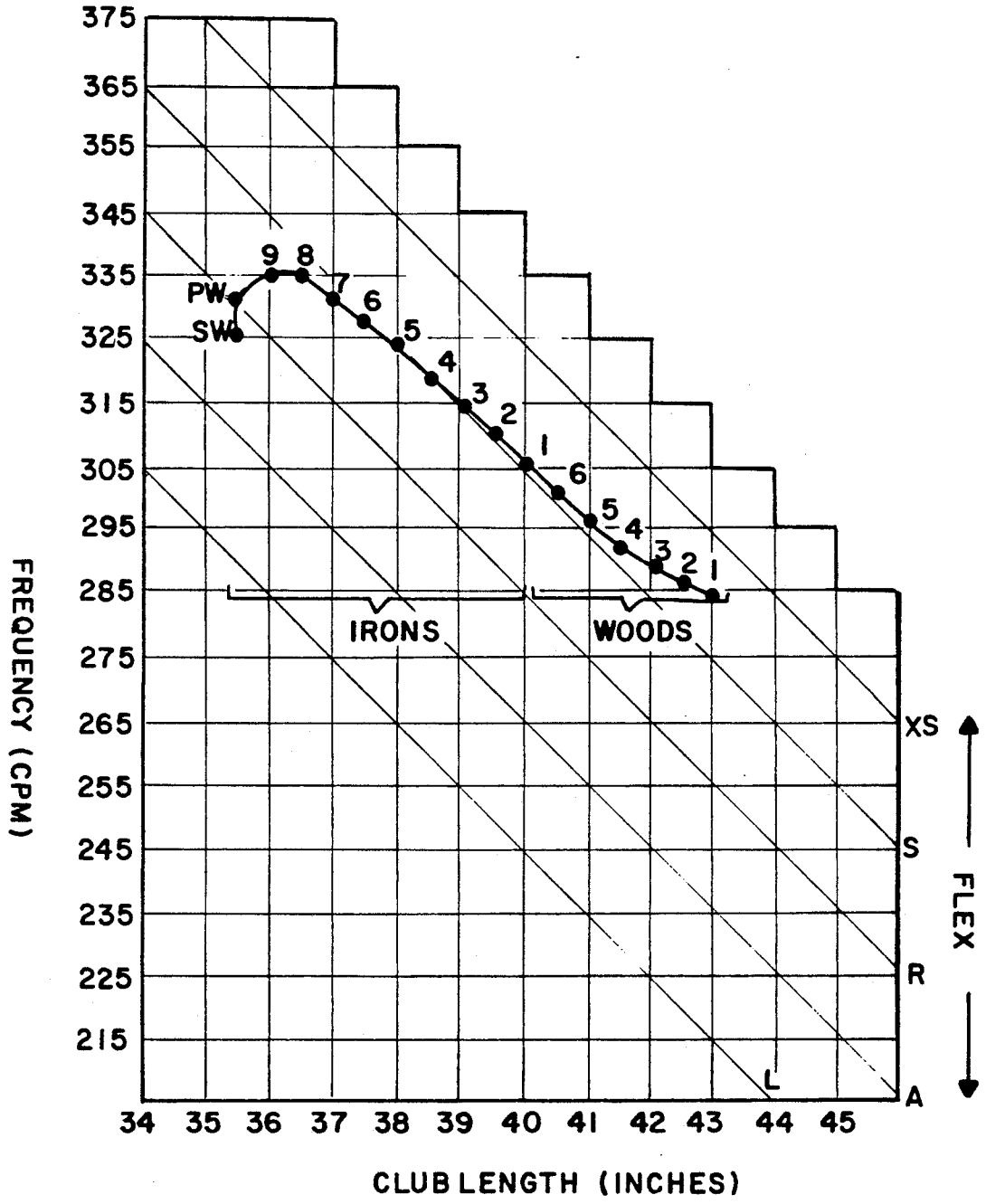
FIG. 8 is a plot of a curve showing the relationship between club length and natural frequency of each club in a set of clubs for a set of golf clubs deemed to be a matched set for a set based upon an inherent frequency gradient of 10 cpm/inch.

Thereafter, the remaining clubs are produced by selecting shafts and appropriate club heads which have substantially the same spectral response curve as the favorite club's curve excepting that the spectral response curve is shifted. In a plot of the relationship of length of club (directly proportional to the club number with the driver or 1 wood being the longest and the wedges the shortest) versus the natural frequency (in cpm) the shift in the spectral response curve when going from one club to the next higher or lower club produces a backward "S" curve such as the one shown in FIG. 8. As shown, the curve becomes convex between about the eight iron and sand wedge (SW) and concave between about the four wood and the driver. The curve between the 8 iron and the 4 wood is less severe, but is not a constant slope. FIG. 8 shows a backward "S" curve for shafts having an inherent gradient (slope) of 10 cpm/inch. Each golf shaft model has a specific inherent gradient which usually ranges from about 8 to about 15 cpm/inch. As a result of this variation, the specific shape of the backwards "S" curve and the increments between successive clubs in a set produced in accordance with the present invention will vary, depending upon the shaft model selected. The shaft model to be selected will depend upon obtaining the best match of spectral response curves.

Table 1 provides appropriate approximate frequency increments between successive clubs for inherent shaft gradients of 8, 10, 12, and 14 cpm/inch. The frequency increment for shaft models having a gradient of 10 cpm/inch between the driver and 2 wood is 2.2 cpm, between 2 wood and 3 wood 2.8 cpm, etc.

TABLE I

| Club | Length of Standard Club | Frequency Increments Between Successive Clubs at Various Gradients (CPM) | | | |
|---|---|---|---|---|---|
| | | 8 | 10 | 12 | 14 |
| Driver | 43" | | | | |
| | | >1.0 | >2.0 | >3.0 | >4.0 |
| 2 Wood | 42½ | | | | |
| | | >2.0 | >2.5 | >3.7 | >4.5 |
| 3 Wood | 42 | | | | |
| | | >2.3 | >3.5 | >4.3 | >5.6 |
| 4 Wood | 41½ | | | | |
| | | >3.0 | >4.0 | >5.2 | >6.0 |
| 5 Wood | 41 | | | | |
| | | >3.4 | >4.3 | >5.4 | >6.4 |
| 6 Wood | 40½ | | | | |
| | | >3.5 | >4.4 | >5.5 | >6.5 |
| 1 iron | 40 | | | | |
| | | >3.6 | >4.7 | >5.6 | >6.6 |
| 2 iron | 39½ | | | | |
| | | >3.8 | >4.8 | >5.7 | >6.7 |
| 3 iron | 39 | | | | |
| | | >3.9 | >4.9 | >5.9 | >6.8 |
| 4 iron | 38½ | | | | |
| | | >3.8 | >5.0 | >5.7 | >7.0 |
| 5 iron | 38 | | | | |
| | | >3.6 | >4.5 | >5.4 | >6.5 |
| 6 iron | 37½ | | | | |
| | | >3.3 | >3.5 | >5.2 | >6.3 |
| 7 iron | 37 | | | | |
| | | >3.1 | >2.0 | >4.5 | >6.0 |
| 8 iron | 36½ | | | | |
| | | >1.0 | >0 | >2.0 | >4.0 |
| 9 iron | 36 | | | | |
| | | >−5.0 | >−4.8 | >−4.0 | >−2.0 |
| PW | 35½ | | | | |
| | | >−5.0 | >−4.5 | >−4.0 | >−3.5 |
| SW | 35½ | | | | |

The increments shown in Table 1 are appropriate for duplicating shafts with nominal inherent gradients (slopes) of 8, 10, 12, and 14 cpm/inch. Other shafts, for example those with a 13 cpm/inch, require extrapolation of the increments shown in Table 1. As the inherent cpm/inch value for shaft model shifts, plot of the relationship of length of club versus the natural frequency of a set of clubs produces the backward "S" curve relationship. In this manner an entire set of clubs can be manufactured with each club having the same performance characteristics as a single specific club.

The following Example illustrate the duplication of a single golf club and preparing other clubs therefrom. It is illustrative of the invention and should not be considered as limiting the invention.

EXAMPLE

Figure 9:
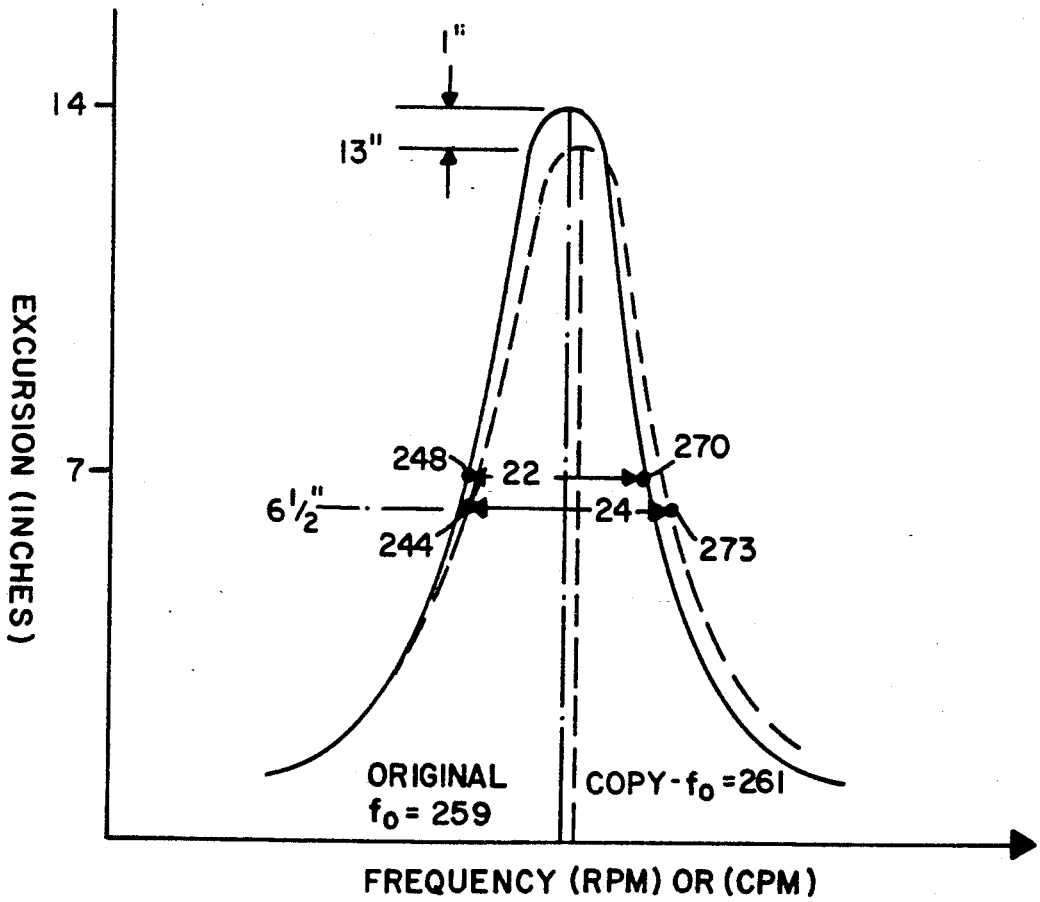
FIG. 9 is a plot of the spectral response curve for two matched golf clubs from the Example.

A driver (1 wood) was oscillated using an oscillating means as shown in FIG. 2 except a ruler was used instead of an optical sensor array to measure the excursion of the club head. The frequency and excursion measurements were taken over a range of frequencies of from 200 to 800 cycles per minute (CPM). The frequency and excursion measurements were then plotted to form a spectral response curve unique to the club. The curve is shown in FIG. 9 as a solid line. From a stock of other shafts with predetermined spectral response curves a shaft having substantially the same spectral response curve was selected and a dummy head having approximately the same weight as the head of the club being duplicated was attached. Its curve is shown as the dotted line in FIG. 9. As can be seen from FIG. 9, the frequencies of the two curves were within about ±2 CPM at all points, the height of the peak at the natural frequency of the club being copied was 1.0 inch higher than the height of the $f_o$ peak of the new club. The width of the peak at 50% of the height of the peak for the master club was 22 CPM and the width of the peak at 50% of the height of the peak for the new club was 24 CPM, giving a difference of 2 CPM. At 70% of the maximum heights, i.e. Q, the difference is even less. The new club was then provided with a club head of the same loft and lie as the master club and a grip diameter substantially the same as that of the master club. The club head and grip were selected to appear the same as on the master club. When used on a driving range, a player could not distinguish between them.

A 5-iron is prepared to match the characteristics of the above driver (which had been prepared from a shaft having an inherent gradient of 10 cpm/inch). In accordance with Table I and FIG. 8, 5-iron is produced having (i) a length 5 inches shorter than the driver, (ii) a natural frequency of 300 cpm, i.e. 40.1 cpm greater than that of the driver, and (iii) a spectral response curve having a maximum height of 13.4 inches and a width Q of 23 cpm. The 5-iron is produced by selecting a commercially available shaft of the same shaft model and having the desired spectral response curve, cutting that shaft to the appropriate length, and attaching a 5-iron head and grip. When used on a driving range by the player for whom the driver was prepared, the 5-iron feels substantially the same.

What is claimed is:

1. A method of duplicating a golf club comprising attaching a golf club, having a grip end and a club head end, to be duplicated to an oscillating means; oscillating the golf club over a range of frequencies and measuring at each frequency the excursion of the club head; plotting the frequency versus the excursion measurements so as to form a spectral response curve; determining the natural frequency of the golf club; selecting a golf club shaft which, when a golf club head is attached thereto and when oscillated over a range of frequencies, has substantially the same spectral response curve at least at about the portion of the curve at about the natural frequency of the golf club being duplicated; and attaching a golf club head to the selected shaft.

2. The method of claim 1, wherein the golf club shaft that is selected has substantially the same spectral response curve over substantially the entire curve as the golf club that is being duplicated.

3. The method of claim 1, wherein the spectral response curves at the portions of the curves being matched of the two golf clubs have amplitudes at each point on the respective spectral response curves that are within about 4% of each other.

4. The method of claim 1, further comprising measuring the torque of the golf club being duplicated and selecting a golf club having substantially the same torque or less as the golf club being duplicated.

5. The method of claim 1, further comprising measuring the flex point of the club being duplicated and selecting a club having substantially the same flex point.

6. The method of claim 1, further comprising measuring the length of the club being duplicated and selecting a club of substantially the same length.

7. The method of claim 1, further comprising measuring the phase angle of the club being duplicated and selecting a club having substantially the same phase angle.

8. The method of claim 1, further comprising measuring the swing weight of the club being duplicated and selecting a club having substantially the same swing weight.

9. The method of claim 1, further comprising measuring the overall weight of the club being duplicated and selecting a club having substantially the same overall weight.

10. The method of claim 1, further comprising measuring the grip diameter of the club being duplicated and selecting a club having substantially the same grip diameter.

11. The method of claim 1, further comprising determining the lie and loft of the club head and selecting a club having a club head with substantially the same lie and loft.

12. The method of claim 1, further comprising measuring the peak of the spectral response curve at the natural frequency of the club being duplicated and selecting a club having a natural frequency peak of substantially the same height.

13. The method of claim 1, further comprising measuring the width of the selectivity Q of the curve of the club being duplicated and selecting a shaft which, when a club head is attached, has substantially the same selectivity Q.

14. A method of preparing a new golf club comprising attaching a first golf club having a grip end and a club head end to an oscillating means; oscillating the golf club over a range of frequencies and measuring at each frequency the excursion of the club head; plotting the frequency versus the excursion measurements so as to form a spectral response curve; determining the natural frequency of the first golf club; selecting a new club having a spectral response curve which is substantially the same as the spectral response curve of the first golf club, at least at about the portion of the curve at about the natural frequency of the first golf club, except that the natural frequency for the new club is shifted from that of the first club in such a manner that for each adjacent club in a set of fourteen clubs the natural frequency shift forms a backwards S curve when the natural frequencies of a set of fourteen different clubs is plotted on the vertical axis versus the length of each club on the horizontal axis.

15. The method of claim 14, wherein the backwards S curve is convex from about the eight iron through the higher numbered irons and concave from about the four wood through the lower numbered woods.

16. A method of producing a matched series of golf club irons which include at least 5 different clubs between a 2-iron and a sand wedge which comprises: attaching a first golf club having a grip end and a club head end to an oscillating means; oscillating the golf club over a range of frequencies and measuring at each frequency the excursion of the club head; plotting the frequency versus the excursion measurements so as to form a spectral response curve; determining the natural frequency of the first golf club; selecting the at least 5 different clubs each having spectral response curves which are substantially the same as the spectral response curve of the first golf club at least at about the portion of the curve at about the natural frequency of the first golf club, except that the natural frequency for each adjacent club in the series shifts in a manner so as to form a curve which is convex from the 8-iron to the sand wedge when the natural frequency of the series of irons is plotted on the vertical axis versus the length of each club on the horizontal axis.

17. A method of producing a matched series of golf club woods which include at least 4 different woods between a 5-wood and a driver which comprises: attaching a first golf club head end to an oscillating means; oscillating the golf club over a range of frequencies and measuring at each frequency the excursion of the club head; plotting the frequency versus the excursion measurements so as to form a spectral response curve, determining the natural frequency of the first golf club from the curve; selecting the at least four different woods each having a spectral response curve which is substantially the same as the spectral response curve of the first golf club at least at about the portion of the curve at about the natural frequency of the first golf club, except that the natural frequency for each adjacent club in the series shifts in a manner so as to form a curve which is concave from the 5-wood to the driver when the natural frequency of the series of woods is plotted on the vertical axis versus the length of each club on the horizontal axis.

18. A matched series of two or more golf clubs, each club having (i) a substantially similar spectral response curve, at least about the portion of the curve at about the natural frequency of each club, which spectral response curve is formed by plotting the frequency versus the excursion of the club head when each golf club oscillated over a range of frequencies, and (ii) an identical inherent shaft gradient, wherein the natural frequencies of successive clubs are shifted by an amount as determined from the following:

| Club | Length of Standard Club | Frequency Increments Between Successive Clubs at Various Gradients (CPM) | | | |
|---|---|---|---|---|---|
| | | 8 | 10 | 12 | 14 |
| Driver | 43" | | | | |
| | | >1.0 | >2.0 | >3.0 | >4.0 |
| 2 Wood | 42½ | | | | |
| | | >2.0 | >2.5 | >3.7 | >4.5 |
| 3 Wood | 42 | | | | |
| | | >2.3 | >3.5 | >4.3 | >5.6 |
| 4 Wood | 41½ | | | | |
| | | >3.0 | >4.0 | >5.2 | >6.0 |
| 5 Wood | 41 | | | | |
| | | >3.4 | >4.3 | >5.4 | >6.4 |
| 6 Wood | 40½ | | | | |
| | | >3.5 | >4.4 | >5.5 | >6.5 |
| 1 iron | 40 | | | | |
| | | >3.6 | >4.7 | >5.6 | >6.6 |
| 2 iron | 39½ | | | | |
| | | >3.8 | >4.8 | >5.7 | >6.7 |
| 3 iron | 39 | | | | |
| | | >3.9 | >4.9 | >5.9 | >6.8 |
| 4 iron | 38½ | | | | |
| | | >3.8 | >5.0 | >5.7 | >7.0 |
| 5 iron | 38 | | | | |
| | | >3.6 | >4.5 | >5.4 | >6.5 |
| 6 iron | 37½ | | | | |
| | | >3.3 | >3.5 | >5.2 | >6.3 |
| 7 iron | 37 | | | | |
| | | >3.1 | >2.0 | >4.5 | >6.0 |
| 8 iron | 36½ | | | | |
| | | >1.0 | >0 | >2.0 | >4.0 |
| 9 iron | 36 | | | | |
| | | >−5.0 | >−4.8 | >−4.0 | >−2.0 |
| PW | 35½ | | | | |
| | | >−5.0 | >−4.5 | >−4.0 | >−3.5 |
| SW | 35½ | | | | |

* * * * *